United States Patent [19]

Talley

[11] 4,081,395

[45] Mar. 28, 1978

[54] ALKALINE DETERGENT COMPOSITIONS

[75] Inventor: Charles Bullick Talley, Drexel Hill, Pa.

[73] Assignee: Pennwalt Corporation, Philadelphia, Pa.

[21] Appl. No.: 670,305

[22] Filed: Mar. 25, 1976

Related U.S. Application Data

[63] Continuation-in-part of Ser. No. 622,337, Oct. 14, 1975, abandoned.

[51] Int. Cl.[2] ..... C11D 1/08; C11D 1/14; C11D 3/10; C11D 3/34

[52] U.S. Cl. ..... 252/106; 252/135; 252/156; 252/531; 252/534; 252/539; 252/DIG. 10

[58] Field of Search ..... 252/135, 156, DIG. 10, 252/DIG 14, 539, 531, 534, 106

[56] References Cited

U.S. PATENT DOCUMENTS

| | | | |
|---|---|---|---|
| 3,010,907 | 11/1961 | Carroll | 252/135 |
| 3,042,623 | 7/1962 | Greene | 252/539 X |
| 3,306,858 | 2/1967 | Oberle | 252/135 X |
| 3,330,767 | 7/1967 | Herrick et al. | 252/135 X |
| 3,361,675 | 1/1968 | Fuchs et al. | 252/135 X |
| 3,390,092 | 6/1968 | Keast et al. | 252/135 X |
| 3,410,804 | 11/1968 | Walsh | 252/135 X |
| 3,734,859 | 5/1973 | Ward | 252/DIG. 14 X |
| 3,829,386 | 2/1974 | Wegst et al. | 252/135 |
| 3,843,543 | 10/1974 | Hewitt | 252/DIG. 14 X |
| 3,956,161 | 5/1976 | Woodward | 252/DIG. 14 X |
| 3,966,628 | 6/1978 | Woodward | 252/135 |

OTHER PUBLICATIONS

Trask, "Sulfonation and Sulfation of Oils", The Journal of the American Oil Chemists Society, vol. 33, 1956, pp. 568–571.

Kirk–Othmer, Encyclopedia of Chemical Technology, 2nd ed., vol. 19, 1969, pp. 279–280.

Morrison et al., *Organic Chemistry,* Allyn and Bacon, Boston, 1959, pp. 136–137.

*Primary Examiner*—Harris A. Pitlick

*Attorney, Agent, or Firm*—Robert G. Danehower

[57] ABSTRACT

This invention discloses alkaline detergent compositions for cleaning solid surfaces including returnable food and beverage containers such as are used for milk, ice cream mixes, soft drinks and similar materials. The alkaline detergent compositions are particularly adapted for cleaning bottles fabricated from polycarbonate resins without damaging the polycarbonate but are also useful on glass, polypropylene and polyethylene surfaces. Granular detergents, aqueous concentrates and aqueous use solutions are described. The alkaline detergents can be used in mechanical spray or soak-tank washers.

13 Claims, No Drawings

ALKALINE DETERGENT COMPOSITIONS

DESCRIPTION OF INVENTION

This is a continuation-in-part application of Ser. No. 622,337 filed Oct. 14, 1975 and now abandoned for Detergent Composition of Cleaning Polycarbonate Resins.

The desire to use a clear glass-like polymer that doesn't break has lead to the development of polycarbonates which can be formed into sheet, film, plate or which can be molded into articles. The preparation and properties of these polymers are described in the Encyclopedia of Polymer Technology, Volume 10 beginning on page 710. Since polycarbonates are essentially linear thermoplastic polyesters of carbonic acid, they are readily susceptible to chemical attack by free alkali.

On the other hand, glass containers and processing equipment presently in use in the dairy industry in contact with milk, ice crean and other milk products require free alkali at a pH of about 13 to peptize the fatty acid soils which enables them to be removed by detergent action. Another type of soil encountered in the dairy field are the usual contaminating molds which grow on the soiled food container walls. Removal of soils in the dairy industry require strong alkaline detergents and cleaners which will perform satisfactory in either mechanical spray or soak-tank cleaning operations.

Glass containers such as glass milk bottles frequently break with resulting injury to both dairy personnel and the milk consumer. This has let to the use of polypropylene, polyethylene and polycarbonate returnable food containers. The use of smooth, clear and transparent polycarbonate milk containers has, in the past, been unsuccessful due to chemical attack by conventional bottle cleaners employing strong alkali.

I have now discovered alkaline detergent compositions for use in aqueous solution which will clean soiled surfaces. These detergent compositions will peptize fatty acid soils in food products such as milk at a pH of about 8 to 12. Repeated washings of 75 cycles or more have demonstrated that these new alkaline compositions do not attack polycarbonate, polypropylene, polyethylene or glass surfaces.

The basis of my new cleaning composition is an organic dicarboxylic acid detergent represented by the formula

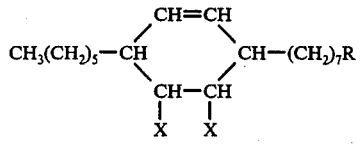

in which one X is hydrogen while the second X is carboxylic, in which R can be COOH and $CH_2OSO_3H$ and their alkali metal salts. For convenience, I use the term C-21 dicarboxylic detergent to include the free C-21 dicarboxylic acid, the sulfate derivative and their sodium or potassium salts. The preparation of C-21 dicarboxylic acid is described in U.S. Pat. No. 3,753,968.

The C-21 dicarboxylic acid sulfate is prepared by sulfating the C-21 dicarboxylic acid by conventional sulfating techniques. Generally, from one-half to one and one-half moles of concentrated sulfuric acid will be added to each mole of C-21 dicarboxylic acid. it is believed that most of the sulfation will take place at the terminal carboxylic group in preference to the carboxylic group attached to the cyclic portion of the molecule. However, it is possible that some sulfation will take place at each carboxylic group.

The alkali metal salts of the C-21 dicarboxylic acid will be formed by the substitution of alkali metal, preferably sodium, for the hydrogen on the hydroxyl groups of the carboxylic groups. The source of the alkali metal will be the free alkali in the alkaline materials such as sodium metasilicate and sodium carbonate. Some of the substitution of sodium for hydrogen will take place in the dry blending operation when the detergent composition is formulated. The substitution will be completed when either the aqueous concentrate or dilute use solutions are prepared.

The alkaline cleaning compositions of my invention are formulated as dry granular compositions which are dissolved in water for the cleaning operation. Aqueous concentrates can also be prepared but are not generally used because of the expense of transporting water. The following description of my compositions will refer to the granular concentrates unless otherwise specified.

The C-21 dicarboxylic detergent will be present in my granular detergent compositions at from about 1 to about 9 percent by weight. Preferably the C-21 dicarboxylic detergent concentration will be about 5 to 7 percent by weight in concentrates for soak tank cleaning and from about 1 to 2 percent by weight for spray applications.

The free alkali required to peptize the fatty acid residues from milk and ice cream soil is principally supplied by alkali builders in my detergent compositions. The alkali builders will be present within the range of about 5 to 28 percent by weight. Preferably, the alkali builder will constitute from about 10 to 20 percent by weight in concentrates for both the soak tank or spray cleaning.

The alkali builders are alkali metal silicate members of a group consisting of sodium metasilicate, potassium metasilicate, sodium orthosilicate, potassium orthosilicate and mixtures thereof. These alkali metal silicate builders are available in either anhydrous or hydrated form. Whenever alkali metal silicate builders are used in the specifications and claims, they are expressed in the anhydrous form unless otherwise specified.

In addition to the C-21 dicarboxylic detergent, detergent action is supplied by alkali metal phosphates which act synergistically with the C-21 dicarboxylic detergent in my cleaning composition. Additionally, the alkali metal phosphates will act as water softening agents by sequestering calcium and magnesium ions in the cleaning water.

The alkali metal phosphates which are used in my detergent composition are supplied by one or more alkali metal phosphates from the group consisting of sodium tripolyphosphate, trisodium phosphate, tetrasodium pyrophosphate, tetrapotassium pyrophosphate and sodium hexametaphosphate. The alkali metal phosphates are used at a concentration of about 5 to 27 percent by weight. For soak tank cleaning, a preferred range of alkali metal phosphate is about 10 to 20% by weight while for spray applications the preferred concentration range is about 15 to 27% by weight of the concentrate.

Another class of ingredients often used in my detergent compositions is detergent builders. Examples of detergent builders which assist in supplying alkalinity to the composition are sodium sesquicarbonate, sodium sesquisilicate, sodium carbonate, sodium bicarbonate and urea. In addition to supplying alkalinity the detergent builders may be useful in helping to suspend, disperse or emulsify soil and in peptizing fats and greases. Certain types of detergent builders in my compositions, such as sodium chloride and sodium sulfate, function as builders due to their great solubility in water with the resulting common ion effect. One or more of the above detergent builders may be used in my detergent concentrates at a concentration of from zero to about 83 percent by weight. The preferred concentration of detergent builder in my soak-tank cleaner will be about 28 to 62 percent by weight while the preferred range for my spray composition will be about 30 to 63 percent by weight of the concentrate.

In order to assist the C-21 dicarboxylic detergent to penetrate the heavy soils encountered, particularly in cleaning milk and ice cream containers, I have found it necessary to use from about 1 to 15 percent by weight of a hydrotrope and penetrating agent which is a polynuclear methyl naphthalene sulfonate alkali metal salt having a molecular weight within the range of about 240 to 260. The methyl naphthalene sulfonate is generally supplied as the sodium or potassium salt and may be a sodium or potassium monomethyl or dimethyl naphthalene sulfonate or mixtures thereof. The sodium salt is cheaper, more generally available and is preferred. This material is commercially available under the trademarks PETRO II and PETRO AA sold by Petrochemicals Co., Inc., TAMOL SN sold by Rohm and Haas Co. and NEKAL N.F. sold by GAF Corporation. A preferred concentration range of alkali metal methyl naphthalene sulfonate is from about 5 to 10 percent by weight of my soak-tank detergent concentrate. For spray applications the preferred range is about 2 to 5 percent by weight of the concentrates.

If additional surface active agents are desired in the cleaning composition conventional wetting agents, emulsifying agents and dispersing agents can be added along with the alkali metal methyl naphthalene sulfonate. I have used from about 0.5 to 5 parts by weight of a surface active agent with 99.5 to 95 parts by weight of my granular concentrates. The surface active agents can be selected from any of the hundreds of available materials so long as they function in alkaline solutions. The surface active agents may be present at a concentration of 0 to 5 percent by weight. The surface active agents useful in my detergent compositions will include the nonionics, the anionics and the amphoterics. Examples of nonionics are octylphenoxy polyethoxy ethanol sold under the trademark TRITON X-45, nonyl phenoxy ethyleneoxy ethanol sold under the trademark IGEPAL CO 850, phenoxy ethoxylated ethanol sold under the trademark EMPHOS TS-211, polyoxyethylene ester of mixed fatty and resin acids sold under the trademark RENEX 20, glycol fatty ester sold under the trademark HALLCO-376-N, fatty acid glycol ester sold under the trademark ADVAWET 33, fatty acid alkanolamide sold under the trademark ALKAMIDE 2110, cetyl dimethyl amine oxide sold under the trademark AMMONYX CO, aliphatic polyether sold under the trademark ANTAROX LF-344, polyoxyethylenated alkyl glycol amide sold under the trademark ANTAROX G-200, fatty alcohol polyether sold under the trademark AROSURF 63-PE-16, polyoxyethylene sorbitol esters of mixed fatty and resin acids sold under the trademark ATLAS G-1234, modified oxyethylated straight-chain alcohol sold under the trademark PLURAFAC D-25 and ethoxylated nonyl phenol sold under the trademark RENEX 648.

Examples of amphoterics are disodium N-tallow betamino dipropionate sold under the trademark DERIPHATE 154, sodium derivative of dicarboxylic caprylic acid sold under the trademark MIRANOL J2M, lecithin sold under the trademark CENTROL CA, LA, lauryl ampholytic (syndet) sold under the trademark SCHERCOTERIC BASE 156, carboxylic acid derivatives of substituted imidazolines sold under the trademark MONATERIC, complex coco betaine sold under the trademark ACCOBETAINE CL, cocyl amido betaine sold under the trademark CARSONAM 3 and 3147, fatty sulfobetaine sold under the trademark LONZAINE CS, dicarboxylic coconut derivative isopropanolamine sold under the trademark MIRANOL IPA, dicarboxylic coconut derivative triethanolamine sold under the trademark MIRANOL TEA, dicarboxylic coconut derivative sodium salt sold under the trademark MIRANOL SF, dicarboxylic octoic derivative sodium salt sold under the trademark MIRANOL JEM, dicarboxylic myristic derivative diethanolamine sold under the trademark MIRANOL M2M-DEA, dicarboxylic myristic derivative monoethanolamine sold under the trademark MIRANOL M2M-MEA, dicarboxylic myristic derivative sodium salt sold under the trademark MIRANOL M2M-SF, dicarboxylic carboxylic capric derivative diethanolamine sold under the trademark MIRANOL S2M-DEA and dicarboxylic capric derivative triethanolamine sold under the trademark MIRANOL S2M-TEA.

Examples of anionics are ethoxylated (3 moles) phosphate ester sold under the trademark TRITON QS-44, sodium sulfate of 2 ethyl-1-hexanol sold under the trademark TERGITOL 08, sodium petroleum sulfonate sold under the trademark PETRONATE K, sodium alkyl naphthalene sulfonate sold under the trademark PETRO AR, SELLOGEN K, NEKAL BX-78, ALKANOL B and others, dioctyl ester of sodium sulfosuccinic acid sold under the trademark AERESOL OT, sodium alkylaryl sulfonate sold under the trademark AHCOWET ANS, sodium salt of sulfated alkylphenoxy poly (ethyleneoxy) ethanol sold under the trademark ALIPAL EO-526, sodium methyl n-oleyl-taurate sold under the trademark AMATERG T, alkyl polyphosphate sold under the trademark ATCOWET C2, sodium lauryl sulfate sold under the trademark AVIROL 101, sodium N-methyl-N-tall oil acids taurate sold under the trademark IGEPON TK-32, lauric alkylolamine condensate sold under the trademark NOPCOGEN 14-L, fatty alcohol sulfate modified sold under the trademark RICHONOL 4740 and modified diethanolamides of fatty acids sold under the trademark SHERCOMID.

The combined amounts of alkali metal methyl naphthalene sulfonate and surface active agents will not exceed about 20 percent by weight of the alkaline detergent concentrates.

The C-21 dicarboxylic detergents and the sodium methyl naphthalene sulfonate tend to induce foaming characteristics in the dilute aqueous solutions of my detergent compositions particularly when sprayed. If this foaming is undesirable it can be controlled by the use of about 2 to 6 percent by weight of a defoaming agent. The defoaming agent may be used at a concentration ranging from 0 to about 6 percent by weight. For soak-tank compositions, it will generally be used at a concentration of about 3 to 5 percent in the detergent concentrate while a preferred concentration for spray cleaners is about 4 to 6 percent by weight. The defoaming agent can be selected from any of a number of products available for this purpose, including mixtures thereof, the only requirement being that the defoaming agents be effective under the alkaline conditions in which my cleaner composition is formulated and used. In those applications where foam is desired or can be tolerated then a defoaming agent is unnecessary.

The defoaming agents may be selected from the groups consisting of mineral oils, vegetable oils and organic foam modifying agents. Suitable defoaming agents include white mineral oils sold under the trademarks DRAKEOL 5, 10, 21 and 35; fatty acid vegetable oil sold under the trademark PAMOLYN, and organic materials such as modified oxyethoxylated straight chain alcohols, such as the PLURAFAC RA20, RA30, RA40, and RA43; alkylaryl polyether sold under the trademark TRITON CF10; trifunctional polyoxyalkylene glycols such as PLURADOT HA410 and HA430; diethylene glycol dioleate, polyethylene glycol recinoleate, polyethylene glycol dioleate, tridecyl alcohol, nonylphenol, and ethylene oxide condensation product with propylene oxide - propylene glycol base such as the PLURONIC L61, L62LF, L81 and L122.

I have found it desirable in my detergent concentrates to use sodium bicarbonate as a buffering agent and I use about 5 to 15 percent by weight of this material. A preferred concentration of sodium bicarbonate is from about 5 to 10 percent in both my soak-tank cleaners and spray cleaners.

I have found it convenient to sell my detergent composition as granular solid compositions. They are, of course, readily soluble in water and aqueous concentrates containing up to 40 percent by weight of the detergent are also available. The aqueous concentrates are amber colored.

The range of the above ingredients in my granular detergent compositions are shown below in Table I.

soil is encountered. As indicated previously, a high pH is required for peptizing fats in food and my cleaning solutions will have a pH of about 8 to 12. Preferably the pH of the use solutions will be about 10 to 11. For cleaning polycarbonate milk containers in a continuous soak tank cleaning operation, I have used from about 1 to 3% by weight of my granular detergent composition in water.

For spray applications, I have used my granular concentrates in solutions ranging from about 0.25 to 5 percent by weight. Because of the pressure used in spray operations I have found that for most applications, the granular concentrates can be used at concentrations lower than required for mechanical soak-tank cleaning. For example, for spray washing polycarbonate windows the concentration of detergent in water will be from about 0.25 to about 0.5 percent by weight. For spray washing polycarbonate and glass milk bottles I have used my granular concentrates at about 1.5 to 3 percent by weight. Cleaning time will vary from a few seconds required in washing polycarbonate sheets used as windows in railroad cars and buses to about 30 minutes required in soak tank cleaning.

The temperatures required for my aqueous cleaning solutions will vary from ambient temperatures for window washing to about 190° F. for mechanical washing machines. For soak tank cleaning of polycarbonate milk bottles, I use temperatures of about 150° F. For spray washing of returnable milk containers I have used solution temperatures ranging from 120° to 160° F. The detergent solutions can be sprayed on the articles being cleaned or the articles can be immersed in the aqueous use solutions of my C-21 dicarboxylic detergent. After the cleaning operation the containers are rinsed with clean water which can be cold or hot as desired. After the soil has been removed and the containers have been rinsed with water, they can be sanitized by contacting them with water containing about 200 parts per million of chlorine. Contact with the aqueous chlorine solution

TABLE I

| | Granular Alkaline Detergent Concentrates | | |
|---|---|---|---|
| | Detergent Concentrate Percent Weight | Preferred Concentrate For Soak-Tank Cleaning Percent Weight | Preferred Concentrate For Spray Applications Percent Weight |
| C-21 dicarboxylic detergent | 1–9 | 5–7 | 1–2 |
| Alkali metal silicate builder | 5–28 | 10–20 | 10–20 |
| Alkali metal phosphate | 5–27 | 10–20 | 15–27 |
| Alkali metal methyl naphthalene sulfonate | 1–15 | 5–10 | 2–5 |
| Foam modifying agent | 0–6 | 3–5 | 4–6 |
| Sodium bicarbonate | 5–15 | 5–10 | 5–10 |
| Detergent builder | 83–0 | 62–28 | 63–30 |

These materials are dry blended in conventional ribbon or other type blenders. If the C-21 dicarboxylic detergent is the free dicarboxylic acid or a free sulfate these materials will react with the sodium present in the alkalis or detergent builders to form the sodium salts. Complete reaction at the blending stage is unimportant since the free alkali in the aqueous use solutions will react with any remaining acidic groups.

My granular detergent compositions are used in water at a concentration ranging from about 0.25 to 5 percent by weight.

For soak-tank cleaning where difficult to remove soil is encountered such as ice cream mixes and food molds, I find it desirable to use a concentration of about 3 percent by weight of my detergent in water. Concentrations as high as 5 percent by weight can be used if necessary for particular applications where extremely heavy may vary from about 30 seconds to several minutes. The temperature of the chlorine sanitizing solution generally does not exceed 120° F. because of limited chlorine solubility at higher temperatures. Following sanitizing, the food containers are again rinsed with clean water.

It is also possible to both clean and sanitize containers simultaneously by incorporating a compound which will liberate active chlorine in aqueous solution such as chlorinated trisodium phosphate and the sodium and potassium salts of dichloroisocyanuric acid. These sanitizing materials when used are formulated to give from 50 to 300 parts per million of available chlorine. In the granular concentrates from about 1 to 3 parts by weight of the dichloroisocyanurates are combined with about 99 to 97 parts by weight of granular concentrates. If I use the chlorinated trisodium phosphate, I combine about 5 to 12 parts by weight with about 95 to 88 parts by weight of the granular concentrate.

I have also found it desirable to use an antistatic agent in my cleaning solution when my C-21 dicarboxylic detergent is used in an immersion cleaning operation, such as in soak tank cleaning. The antistatic agent prevents the soil removed in the cleaning operation from redepositing out of solution onto the article being cleaned. An antistatic agent is not generally required in a spray cleaning application.

From about 0.5 to 2 parts by weight of antistatic agent will generally be combined with from 99.5 to 98 parts by weight of my C-21 dicarboxylic detergent concentrates. The antistatic agent, when required, is added to the soak cleaning tank. Alternatively, the antistatic agent in the same proportions may be formulated as part of the C-21 dicarboxylic detergent sold in granular form or as a liquid concentrate. The antistatic agent can be any one or more of a large number of available materials, the principal requirement being that it be stable in the alkaline use solutions. The nonionic and amphoteric antistatics are generally satisfactory.

Typical nonionic antistatic agents are the glycol fatty ester sold under the trademark HALCO C-376-N and HALCO C-1047, the nonylphenoxy polyethyleneoxy ethanols sold under the trademarks IGEPAL CO-520, IGEPAL CO-530, IGEPAL CO-430 and IGEPAL CO-850, fatty acid glycol ester sold under the trademark KERIPON NC, polyethylene glycol ester monolaurate sold under the trademark LONGZEST PEG-4-0, ethylene oxide condensate sold under the trademark MERPOL OE, MORPOL OJ and MERPOL OJS, polyoxyethylene sorbitan monolaurate sold under the trademarks HALCO CPH-376N, HALCO CPH-377N and HALCO CPH-378N, propylene oxide condensates with hydrophillic base formed by condensing ethylene oxide with ethylene glycol sold under the trademarks PLURONIC 10 R 8, 17 R 8, 25 R 5, 25 R 8, 31 R 4, F-38, F-68, F-77, F-87, F-88, F-98, F-108 and F-127, ethoxylated propylene oxide ethylene diamine condensate sold under the trademarks TETRONIC 304, TETRONIC 504, TETRONIC 704, TETRONIC 707, TETRONIC 904, TETRONIC 908, TETRONIC 1104, TETRONIC 1107, TETRONIC 1307 and TETRONIC 1508.

Amphoteric antistatic agents include O-cetyl betaine sold under the trademark Product BCO, o-decyl betaine sold under the trademark Product BDO, N-lauryl betaine sold under the trademark Product DDN, N-cetyl betaine sold under the trademark Product HDN, N-stearyl betaine sold under the trademark Product ODN and N-oleyl betaine sold under the trademark Product UDN, palmityl dimethyl ammonium carboxylic acid betaine sold under the trademark VELVETEX BP, polyoxyethylene alkylamine sold under the trademark ATLAS-G-3780A and reaction product of coco amine and crotonic acid sold under the trademark ARMEEN Z.

The best mode of practicing my invention will be apparent from the following examples.

EXAMPLE 1

One gallon Lexan polycarbonate bottles soiled by sour milk and milk molds were fed to an automatic bottle washing machine. Conveyor chains carried the bottles submerged in an upright position through the soak tank section of the bottle washing machine. The soak tank section contained 3 pounds of my detergent composition for every 100 pounds of water. The detergent composition was prepared by adding 1 pound of ARMEEN Z [A] antistatic agent to 99 pounds of the following composition:

| INGREDIENT | GRANULAR DETERGENT PERCENT WEIGHT |
|---|---|
| C-21 dicarboxylic acid | 6 |
| trisodium phosphate (anhydrous) | 7 |
| soda ash (light) | 33 |
| sodium metasilicate pentahydrate | 30 |
| tetrasodium pyrophsophate | 7 |
| sodium methyl naphthalene sulfonate | 7 |
| defoaming agent[B] | 4 |
| sodium bicarbonate | 5 |
| wetting agent[C] | 1 |

[A]N-coco beta aminobutyric acid
[B]Ethoxylated straight chain alcohol sold under the trademark PLURAFAC RA-43
[C]Primary phosphate monoester made by combining polyphosphoric acid and hydroxylic compound sold under the trademark TRITON QS-44

The pH of the detergent solution was pH 11.8 and the temperature was about 150° F. The soiled milk bottles were in contact with the detergent solution for about 7 minutes. The bottle washing machine then withdrew the bottles from the soak tank, inverted them so that the soil and detergent solution drained back into the soak tank after which the inverted bottle passed into a first rinse tank. In this section of the bottle washing machine, a stream of clean water at about 140° F. was sprayed into the bottle and allowed to drain. Water rinsing was accomplished in about one minute and then the bottle moved into the sanitizing tank where a stream of water containing 200 parts per million of chlorine was sprayed into the inverted bottle. The sanitizing spray temperature was about 120° F.

The bottle was in contact with the sanitizing solution for about one minute after which it was moved by the conveyor chain into the final water rinse tank. This rinse was cold potable water and was also sprayed into the inverted bottle. The cleaned milk bottles then moved by the conveyor to the milk filling station. All soils and molds were removed in the washing operation and the bottles had a clean and attractive appearance. Swab tests showed that the cleaned bottles had a low bacteria count.

EXAMPLE 2

One-quarter part by weight of the granular detergent used in Example 1 without the antistatic agent was dissolved in 99.75 parts by weight of clean water. This solution at ambient temperature and pH of 10.4 was then sprayed onto a flat polycarbonate surface, soiled with condensed milk which was allowed to incubate for 1 month at room temperature. Spray was applied at 30 p.s.i.g. for about 45 seconds after which the detergent solution was rinsed with clean cold water for about 30 seconds. After air drying the washed resin surface was clean and free of water spots and film.

EXAMPLE 3

The following detergent compositions were formulated and then dissolved in tap water at three percent by weight concentration.

| INGREDIENT | COMPOSITION A | COMPOSITION B |
|---|---|---|
| C-21 dicarboxylic acid | 5.0 | 7.0 |

-continued

| INGREDIENT | COMPOSITION A | COMPOSITION B |
|---|---|---|
| sodium metasilicate pentahydrate | 20.0 | 35.0 |
| Trisodium phosphate (anhydrous) | 7.0 | 9.0 |
| sodium methyl naphthalene sulfonate | 5.0 | 10.0 |
| tetrasodium pyrophosphate | 6.0 | 9.0 |
| defoaming agent[D] | 3.0 | 5.0 |
| detergent builder (soda ash) | 49.0 | 15.0 |
| sodium bicarbonate | 5.0 | 10.0 |

[D]Modified oxyethylated straight chain alcohol sold under the trademark PLURAFAC RA-43

Detergent composition A had a pH of 11.3 while B had a pH of 11.7. Lexan polycarbonate plates soiled with condensed milk incubated for 2 weeks at room temperature were immersed in the solutions of 3A and 3B, respectively, and held at 150° F. for 7 minutes. After removal from the detergent solutions the plates were drained, rinsed with tap water and air dried. The Lexan plates from both solutions were clean and free of water spots.

EXAMPLE 4

Forty parts by weight of the granular detergent of Example 1 were dissolved in 60 parts by weight of clean water. The aqueous C-21 dicarboxylic detergent concentrate was a non-viscous amber colored liquid. Detergent use solutions were prepared from this liquid concentrate by mixing 100 parts by weight of the forty percent solution with 1273 parts of water. This gave a 3 percent by weight use solution.

EXAMPLE 5

The following C-21 dicarboxylic detergents were dry blended and then tested for cleaning capability in dilute aqueous solutions.

| INGREDIENT | COMPOSITION A | COMPOSITION B | COMPOSITION C |
|---|---|---|---|
| C-21 dicarboxylic acid | 6.0 | — | 6.0 |
| C-21 dicarboxylic sulfate | — | 6.0 | 3.0 |
| Soda ash (light) | 33.0 | 33.0 | 30.0 |
| Trisodium phosphate (anhydrous) | 7.0 | 7.0 | 7.0 |
| Tetrasodium pyrophosphate | 7.0 | 7.0 | 7.0 |
| Sodium metasilicate ($5H_2O$) | 30.0 | 30.0 | 30.0 |
| Sodium methyl naphthalene sulfonate | 7.0 | 7.0 | 7.0 |
| Defoaming Agent | 4.0[B] | 4.0[B] | 4.0[B] |
| Surface Active Agent | 1.0[C] | 1.0[C] | 1.0[C] |
| Sodium bicarbonate | 5.0 | 5.0 | 5.0 |

[B] and [C] see Example 1

The above granular C-21 dicarboxylic detergents (A through C) were separately dissolved in water at 3 percent by weight concentrations. After bringing the temperature to about 150° F. Lexan polycarbonate plates were immersed in the aqueous solutions for 7 minutes. The Lexan polycarbonate plates were soiled with condensed milk which was allowed to incubate for about 2 months. After removal from the detergent solutions, the polycarbonate plates were rinsed with clean water for about one-half minute and then allowed to air dry. The plates which were cleaned by the respective detergent solutions A through C were all clear and free of soil.

EXAMPLE 6

Following the procedure of Example 5, one percent by weight of the following foam modifying agents were separately substituted for the Ethoxylated straight chain alcohol (PLURAFAC RA-43) used in the composition of Example 5-A: sodium salt of dicarboxylic caprylic acid (MIRANOL J2M), disodium N-tallow betamino dipropionate (DERIPHAT 154), nonylphenoxy polyethyleneoxy ethanol (IGEPAL CO 850), sodium sulfate of 2 ethyl-1-hexanol (TERGITOL 08).

Three percent by weight aqueous solutions of the above granular detergents were evaluated against condensed milk soil following the procedure of Example 4. In all cases the polycarbonate plates were clean and clear.

EXAMPLE 7

A granular concentrate was prepared by dry blending the following materials expressed as percent by weight: C-21 dicarboxylic acid-3, sodium metasilicate pentahydrate-5, sodium tripolyphosphate-15, sodium bicarbonate-20, sodium methyl naphthalene sulfonate-5, sodium sesquisilicate (builder)-30, sodium sulfate (builder)-15, ethylene oxide-ethylene glycol condensate antistatic agent (PLURONIC F68LF) -2, and N tallow betaamino dipropionate surfactant (DERIPHAT 154)-5.

The granular concentrate was dissolved in water at 2% by weight concentration. The pH was 10.5. After adjusting the temperature to 190° F. polycarbonate plates which were soiled by incubated condensed milk, were immersed in the solution. Soil from the plates started to lift off almost immediately. Within 5 to 7 minutes, the plates were completely cleaned, but immersion was continued for 15 minutes. After removal from the detergent solution, the plates were water rinsed and air dried. The polycarbonate plates were clear and clean.

EXAMPLE 8

Returnable containers are frequently soiled with aromatic and aliphatic organic materials including gasoline which have a tendency to remain in the pores of the container, survive the container cleaning operation and then contaminate the food. I evaluated my detergent composition for cleaning various containers in which I had stored isooctane, toluene, and mixtures of isooctane and toluene for a period of 14 days at room temperature. Following this storage period, the organic liquids were expelled from the containers rinsed with water and then washed with the following detergent composition — C-21 dicarboxylic detergent - 6, sodium metasilicate - 15, tetrasodium pyrophosphate - 14, sodium methyl naphthalene sulfonate - 7, foam modifying agent - 4, sodium bicarbonate - 5, sodium carbonate - 48 and antistatic agent - 1, all percentages being by weight. I used the cleaner at a concentration of 3% by weight in water by soaking the containers at 145°–150° F. for two minutes and then followed by three water rinses. Following the above cleaning, the containers were filled with milk and held at 37° F. for 10 days. The milk was then analyzed for residual hydrocarbon by gas chromatography using a Perkin-Elmer Model 900 equipped with flame ionization detector.

The milk analyzed at less than 0.5 ppm hydrocarbon for both glass and polycarbonate containers and after exposure to the isooctane, toluene and mixtures of both. The only polyethylene container tested showed an isooctane level in milk at 50 parts per million. The 0.5 parts per million hydrocarbon is the same analytical result (control) obtained when milk was analyzed in the same manner but with no exposure to a container previously filled with hydrcarbon. No hydrocarbon oder was detectable in the milk.

EXAMPLE 9

The following detergent compositions were used at 3% by weight concentration in water to clean polycarbonate panels soiled with two month old residue of ice cream mix and condensed milk mold.

| | A | B | C |
|---|---|---|---|
| | Percent by Weight | | |
| C-21 dicarboxylic acid | 9 | 3 | 1 |
| sodium tripolyphosphate (alkali metal phosphate) | 27 | 5 | 3 |
| alkali metal methyl naphthalene sulfonate | 15 | 15 | 3 |
| sodium bicarbonate | 15 | 7 | 5 |
| sodium metasilicate (alkali builder) | 28 | 5 | 5 |
| sodium sesquisilicate (detergent builder) | 0 | 63 | 83 |
| PLURAFAC RA-43 (foam modifying agent) | 6 | 0 | 0 |
| EMPHOS TS-211 (detergent) | 0 | 1 | 0 |
| HALCO CPH-30-N (antistatic agent) | 0 | 1 | 0 |

The soak cycle for cleaners A and B were 7 minutes at 150° F. followed by a two minute cold water spray rinse. The panels were clean, attractive looking and free of water spots. The C cleaner required a 20 minute soak time at 150° F. to remove the same soil as the A and B cleaners at 7 minutes soak.

EXAMPLE 10

The following granular formulation was dissolved in water and used to clean and sanitize both glass and polycarbonate returnable milk containers: soda ash (dense) - 39.5, C-21 dicarboxylic acid - 1.5, PLURAFAC RA-43 foam modifier - 5.0, antistatic agent - 1.0, sodium tripolyphosphate - 10, sodium hexametaphosphate - 5, sodium metasilicate - 15, sodium bicarbonate - 8, sodium methyl naphthalene sulphonate - 3 and chlorinated trisodium phosphate - 12, all figures being percent by weight. The granular concentrate was used in a spray washer at a concentration of 2.3 to 2.7 percent by weight in water. The washing temperature was held constant within the range of 130° to 140° F. Gallon containers which had been soiled with ice cream mixes from 2 seasons ago were placed inverted into a case and introduced to the washer at the rate of one per minute. The machine provided a 4 minute vertical spray-wash cycle, a five minute vertical spray water rinse cycle and a 1 minute vertical spray water rinse cycle. The water rinses were held at a temperature of about 120° F. The cleaning was very good on both the glass and LEXAN polycarbonate containers with only two passes through the washer. There was no increase in foam level after 30 minutes of operation.

I claim:

1. The granular concentrate for dissolving in water to clean soiled surfaces made from polycarbonate, polypropylene, polyethylene or glass, said concentrate consisting essentially of the following ingredients expressed as percent by weight:

Alkali metal silicate selected from the group consisting of orthosilicates and metasilicates - 5 to 28,
Alkali metal phosphate - 5 to 27,
Alkali metal methyl naphthalene sulfonate - 1 to 15,
Sodium bicarbonate - 5 to 15,
Defoaming agent - 0 to 6,
Detergent builder selected from the group consisting of sodium sulfate, sodium chloride, sodium sesquicarbonate, sodium sesquisilicate, sodium carbonate, sodium bicarbonate, and mixtures thereof - 83 to 0.
and C-21 dicarboxylic detergent represented by the formula

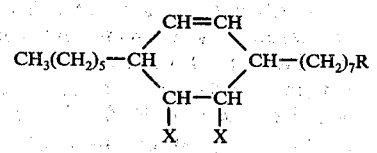

in which one X is hydrogen while the second X is carboxylic, "in which R can be COOH and $CH_2OSO_3H$ and their alkali metal salts" 1 to 9.

2. The detergent concentrate of claim 1 in which the alkali metal phosphate is selected from the group consisting of sodium tripolyphosphate tetrasodium pyrophosphate, tetrapotassium pyrophosphate, trisodium phosphate, sodium hexametaphosphate and mixtures thereof.

3. The granular detergent concentrate of claim 1 to which there is added from about 0.5 to 2 parts by weight of an antistatic agent to about 99.5 to 98 parts by weight of the concentrate of claim 1.

4. The granular detergent concentrate of claim 1 to which there is added about 0.5 to 5 parts by weight of a surface active agent to about 99.5 to 95 parts by weight of the concentrate of claim 1.

5. The granular detergent concentrate of claim 1 to which there is added about 1 to 3 parts by weight of a dichloroisocyanurate to about 99 to 97 parts by weight of the concentrate of claim 1.

6. The granular detergent concentrate of claim 1 to which there is added about 5 to 12 parts by weight of chlorinated trisodium phosphate to about 95 to 88 parts by weight of the concentrate of claim 1.

7. The aqueous detergent solution consisting essentially of water and from about 0.25 to 40 percent by weight of the concentrate of claim 1.

8. The granular concentrate for dissolving in water to clean soiled surfaces made from polycarbonate, polypropylene, polyethylene or glass, said concentrate consisting essentially of the following ingredients expressed as percent by weight:

Alkali metal silicate selected from the group consisting of orthosilicates and metasilicates - 10 to 20,
Alkali metal phosphate - 10 to 20,
Alkali metal methyl naphthalene sulfonate - 5 to 10,
Sodium bicarbonate - 5 to 10,
Defoaming agent - 3 to 5,
Detergent builder selected from the group consisting of sodium sulfate, sodium chloride, sodium sesquicarbonate, sodium sesquisilicate, sodium carbonate, sodium bicarbonate and mixtures thereof - 62 to 28,
and C-21 dicarboxylic detergent represented by the formula

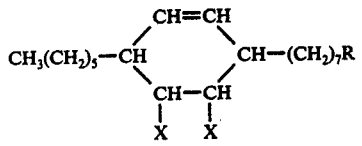

in which one X is hydrogen while the second X is carboxylic, "in which R can be COOH and $CH_2OSO_3H$ and their alkali metal salts" - 5 to 7.

9. The detergent concentrate of claim 8 in which the alkali metal phosphate is selected from the group consisting of sodium tripolyphosphate tetrasodium pyrophosphate, tetrapotassium pyrophosphate, trisodium phosphate, sodium hexametaphosphate and mixtures thereof.

10. The aqueous detergent solution consisting essentially of water and from about 0.25 to 40 percent by weight of the concentrate of claim 8.

11. The granular concentrate for dissolving in water to clean soiled surfaces made from polycarbonate, polypropylene, polyethylene or glass, said concentrate consisting essentially of the following ingredients expressed as percent by weight:

Alkali metal silicate selected from the group consisting of orthosilicates and metasilicates - 10 to 20, Alkali metal phosphate - 15 to 27, Alkali metal methyl naphthalene sulfonate - 2 to 5, Sodium bicarbonate - 5 to 10, Defoaming agent - 4 to 6, Detergent builder selected from the group consisting of sodium sulfate, sodium chloride, sodium sesquicarbonate, sodium sesquisilicate, sodium carbonate, sodium bicarbonate, and mixtures thereof - 63 to 30, and C-21 dicarboxylic detergent represented by the formula

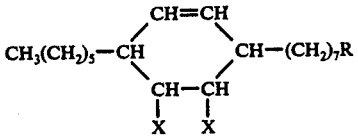

in which one X is hydrogen while the second X is carboxylic, "in which R can be COOH and $CH_2OSO_3H$ and their alkali metal salts" - 1 to 2.

12. The detergent concentrate of claim 11 in which the alkali metal phosphate is selected from the group consisting of sodium tripolyphosphate, tetrasodium pyrophosphate, tetrapotassium pyrophosphate, trisodium phosphate, sodium hexametaphosphate and mixtures thereof.

13. The aqueous detergent solution consisting essentially of water and from about 0.25 to 40 percent by weight of the concentrate of claim 7.

* * * * *